US006033057A

United States Patent [19]

Takagi

[11] Patent Number: 6,033,057

[45] Date of Patent: Mar. 7, 2000

[54] IMAGE FORMING DEVICE INCLUDING TONER SUPPLY UNIT FOR SUPPLYING TONER PARTICLES TO ELECTRODE ARRAY

[75] Inventor: Osamu Takagi, Nagoya, Japan

[73] Assignee: Brother Kogyo Kabushiki Kaisha, Nagoya, Japan

[21] Appl. No.: 09/026,658

[22] Filed: Feb. 20, 1998

[30] Foreign Application Priority Data

Feb. 24, 1997 [JP] Japan ..... 9-038850
Mar. 27, 1997 [JP] Japan ..... 9-075123

[51] Int. Cl.[7] ..... B41J 2/06

[52] U.S. Cl. ..... 347/55

[58] Field of Search ..... 347/55, 154, 12, 347/103, 111, 159, 127, 128, 17, 141, 120, 151; 399/260

[56] References Cited

U.S. PATENT DOCUMENTS 5,036,341 7/1991 Larsson .
5,122,838 6/1992 Kohyama .
5,179,397 1/1993 Ohzeki et al. .
5,650,809 7/1997 Kitamura ..... 347/55
5,745,129 4/1998 Moriyama et al. ..... 347/12
5,860,914 1/1999 Chiba et al. .
5,883,649 3/1999 Maeda ..... 347/55

FOREIGN PATENT DOCUMENTS 6-155798 6/1994 Japan .
6-255163 9/1994 Japan .

*Primary Examiner*—John Barlow
*Assistant Examiner*—Raquel Yvette Gordon
*Attorney, Agent, or Firm*—Oliff & Berridge, PLC

[57] ABSTRACT

A modulating electrode member includes an insulation sheet formed with a plurality of apertures therethrough. A transfer roller is disposed adjacent the modulating electrode member. A blade regulates the toner amount on a peripheral surface of the transfer roller and forms a uniform toner layer of uniformly charged toner particles. The toner layer is conveyed toward the apertures of the modulating electrode member by rotational movement of the transfer roller. The peripheral surface of the transfer roller is made of elastic rubber which offsets uneven pressing force of the blade against the transfer roller. In this way, a toner layer is formed without variation in thickness, thereby preventing variation in toner density in a recorded image.

32 Claims, 7 Drawing Sheets

IMAGE FORMING DEVICE INCLUDING TONER SUPPLY UNIT FOR SUPPLYING TONER PARTICLES TO ELECTRODE ARRAY

BACKGROUND OF THE INVENTION

1. Field of the Invention

The present invention relates to a toner transfer roller used in an image forming device such as a copying machine, a printer, a plotter, a facsimile machine and the like.

2. Description of Related Art

Japanese Laid-Open Patent Application (Kokai) No. HEI-6-155798 describes an image forming device including a modulating electrode member. The modulating electrode member has a plurality of tiny pores (hereinafter referred to as "apertures") therein, and toner passage through the apertures is controlled in accordance with a drive signal applied to respective control electrodes connected to the apertures. The toner particles selectively pass through the apertures and form an image on an image recording medium.

More specifically, as shown in FIG. 1, this type of image forming device 100 includes a modulating electrode member 101, a toner transfer roller 114, a back electrode roller 122, a frame 111 and a circuit 108. The toner transfer roller 114 is made of metal and is rotatably disposed in confrontation with an image recording medium 120 with the modulating electrode member 101 intervened therebetween. The back electrode roller 122 is rotatably disposed in a position opposite the toner transfer roller 114 with respect to the recording medium 120. As shown in FIG. 2, the modulating electrode member 101 includes a 25 $\mu$m thick insulation sheet 102 made of polyimide. The insulation sheet 102 is formed with a plurality of apertures 106, each aperture 106 having a diameter of 100 $\mu$m. The apertures 106 are aligned in a longitudinal direction of the modulating electrode member 101.

Control electrodes 104 are formed on a surface of the insulation sheet 102 facing the image recording medium 120. Each control electrode 104 surrounds a respective one of the apertures 106 and is formed to a thickness of 1 $\mu$m and a width of 20 $\mu$m from cooper foil. The circuit 108 applies control voltages to the control electrodes 104 so that toner particles 116 are selectively pulled through the apertures 106 toward the image recording medium 120. The control signal corresponds to an image signal.

A toner regulation blade 118 is provided for regulating a toner layer on a surface of the toner transfer roller 114 in order to provide a uniform toner layer of uniformly charged toner particles 116.

However, the image forming device 100 described above has some drawbacks. When the modulating electrode member 101 is assembled askew or obliquely fixed to the frame 111, the toner transfer roller 114 may press against the modulating electrode member 101 with poor uniformity along its length. This causes density variation on a recorded image because more toner particles 116 flow through the apertures 106 with the toner transfer roller 114 strongly presses than through the apertures 106 where the toner transfer roller 114 presses with less force.

The amount of the toner particles 116 that flow through each aperture 106 toward the image recording medium 120 also varies depending on the thickness of the toner layer supplied to the apertures 106. More specifically, if the apertures 106 are supplied with an insufficient amount of toner particles 116, then too few toner particles 116 will flow therethrough resulting in toner clinging to the image recording medium 120 in an in sufficient amount. On the other hand, if the apertures 106 are supplied with an excessive amount of toner particles 116, then excessive toner particles 116 will pass therethrough resulting in excessive toner clinging to the image forming medium 120. Also, when excessive toner particles are deposited on the toner transfer roller 114, the toner may enter the apertures 106 when not desired, potentially clogging the apertures 106 or causing fogging on the image forming medium 120.

A variation in the thickness of toner layer with respect to a rotational direction of the toner transfer roller 114 results in variation in density of the recorded image with respect to a sheet feeding direction of the image recording medium 120. On the other hand, variation in thickness of toner layer with respect to a longitudinal direction of the toner transfer roller 114 results in a variation in density of the recorded image with respect to a direction perpendicular to the sheet feeding direction.

A non-uniform pressing force of the blade 118 against the transfer roller 114 is a main cause of variation in thickness of the toner layer. There are various factors which can cause a non-uniform pressing force. For example, the portion of the blade 118 that contacts the transfer roller 114 may not extend with complete straightness in the longitudinal direction along the transfer roller 114. A rounded tip portion R of the blade 118 may have a shape variation. The blade 118 may provide surface irregularities, and undulations. Further, the inaccurate assembly of the blade may cause the variation in toner thickness.

SUMMARY OF THE INVENTION

It is an object of the present invention to solve the above-described problems and to provide an improved toner transfer roller for use in an image forming device capable of providing a uniform toner layer to a modulating electrode member.

To achieve the above and other objects, there is provided an image forming device including an electrode array, a back electrode, and a particle transfer member. The electrode array includes a substrate being formed with a plurality of apertures. A plurality of control electrodes are provided on the substrate for respective ones of the apertures. The back electrode is provided with confronting the substrate. The particle transfer member supplies electrically charged particles to the plurality of apertures. The particle transfer member is provided with confronting the substrate and has a toner carrying surface made of an elastic material.

Also, there is provided a particle transfer member for use in an image forming device. The image forming device including an electrode array, a control electrode driving unit, a back electrode, a back electrode driving unit, and a particle transfer member. The electric array includes a substrate being formed with a plurality of apertures. A plurality of control electrodes are provided on the substrate for respective ones of the apertures. The control electrode driving unit is electrically connected to the plurality of the control electrodes for selectively applying a voltage to the plurality of the control electrodes based on a control signal. The back electrode is provided with confronting the substrate. The back electrode driving unit is electrically connected to the back electrode for supplying a voltage thereto. The particle transfer member supplies electrically charged particles to the plurality of apertures and is provided confronting the substrate. The particle transfer member has a shaft, an elastic body provided over the shaft, and a coating layer formed over the elastic body. The coating layer has an outer peripheral surface serving as a toner carrying surface. The coating layer is made of an elastic material. The coating layer has a thickness from 5 $\mu$m to 40 $\mu$m. The outer peripheral surface has a roughness Rz of 10 $\mu$m or less. An electric resistance of the particle transfer member is $10^7$ Ω order or less.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Figure 1:
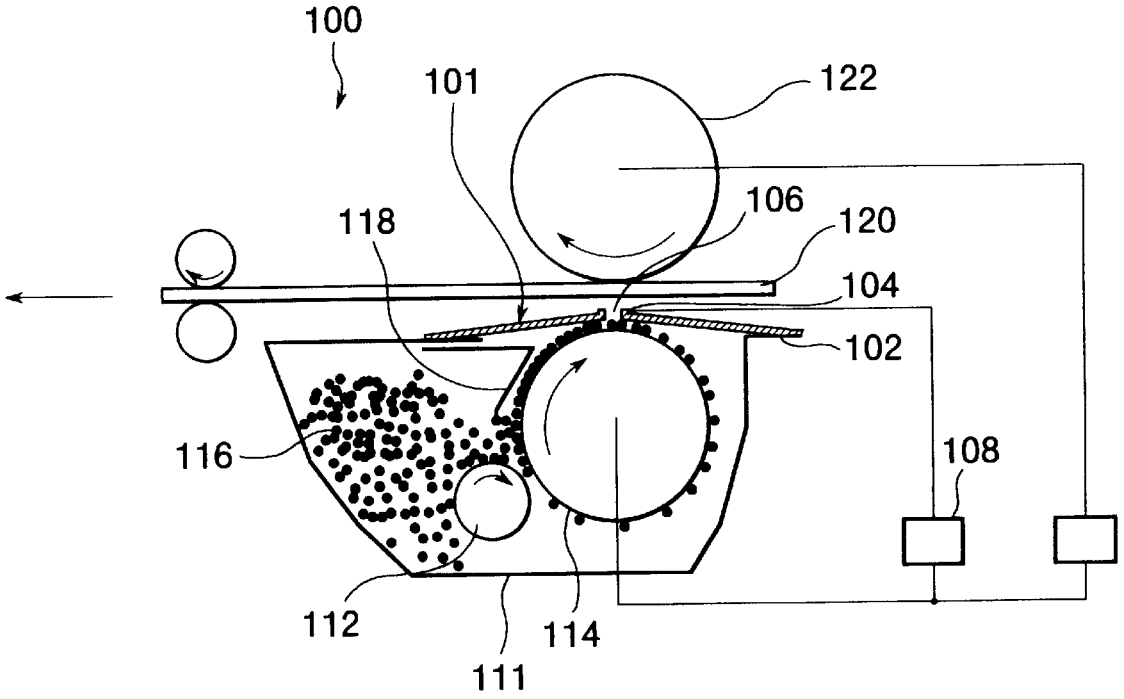
FIG. 1 PRIOR ART
FIG. 1 is a schematic cross-sectional view showing a conventional image forming device.
Figure 2:
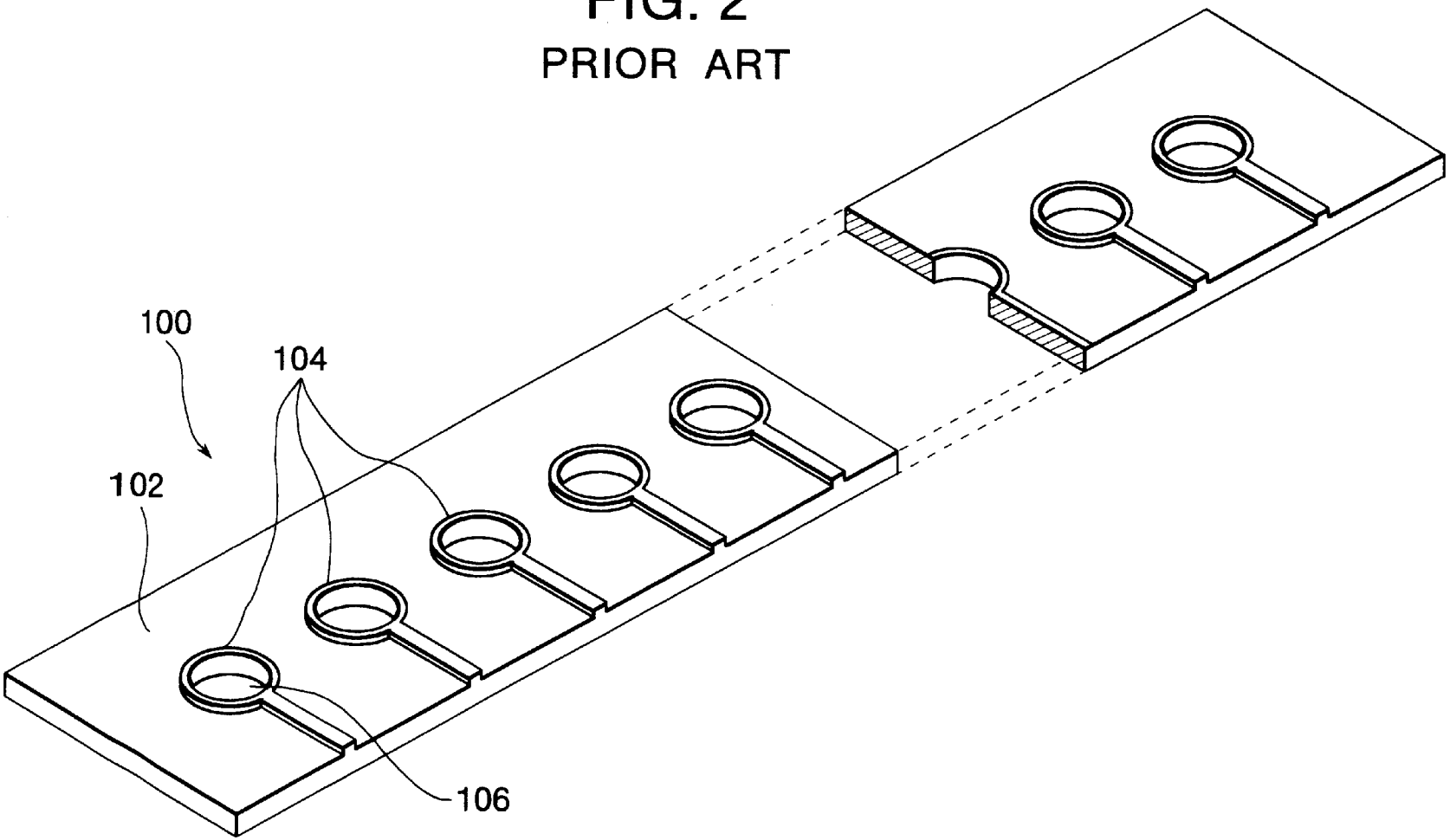
FIG. 2 PRIOR ART
FIG. 2 is a perspective view showing a conventional modulating electrode member.

An image forming device according to preferred embodiments of the present invention will be described while referring to the accompanying drawings wherein like parts and components are designated by the same reference numerals to avoid duplicating description.

In the following description, the expressions "vertical", "upper", and "lower" are used throughout the description to define the various parts when the printer is disposed in an orientation in which it is intended to be used.

First, an image forming device 50 including a transfer roller 14 of a first embodiment will be described.

Figure 3:
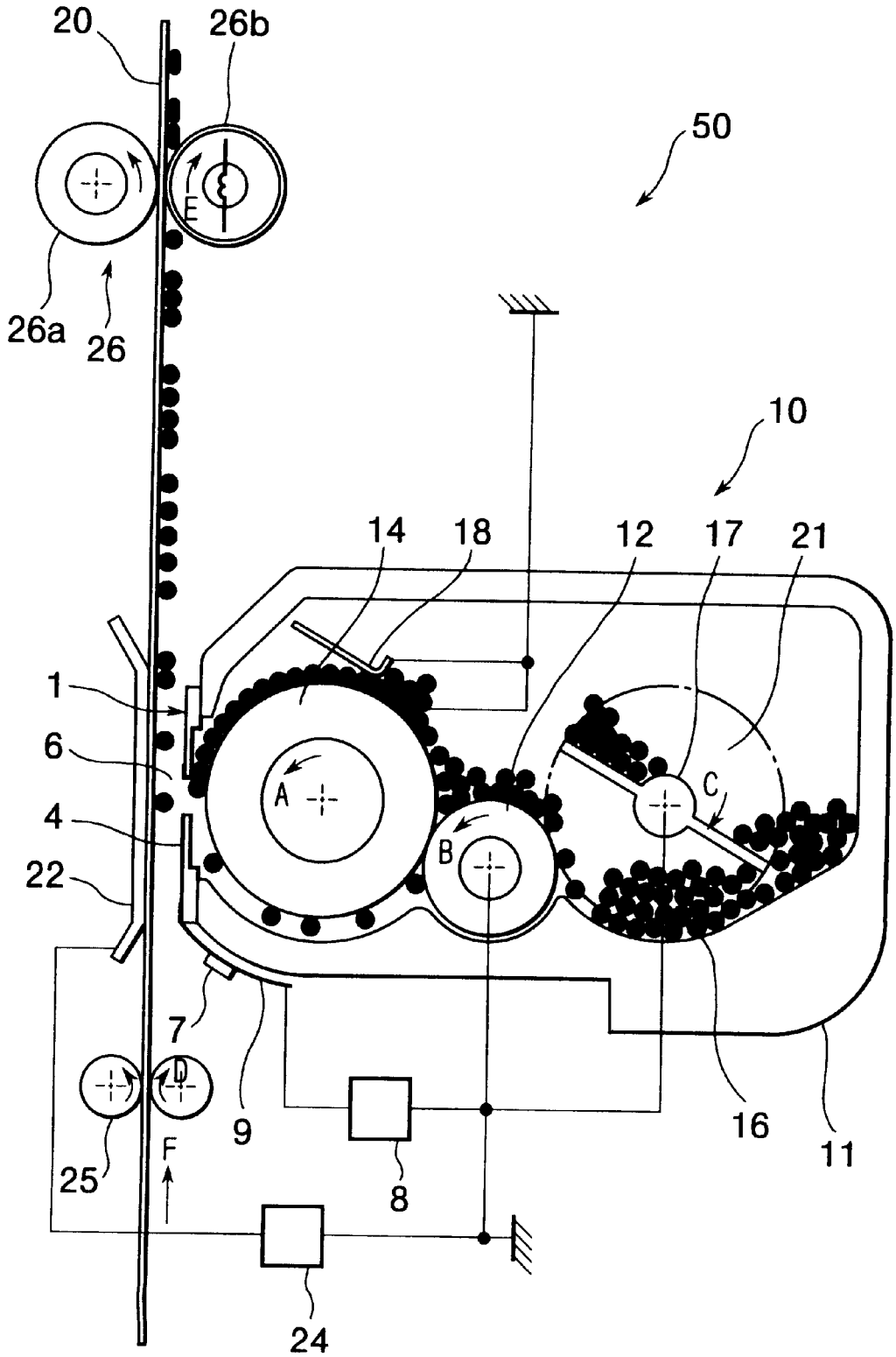
FIG. 3 is a cross-sectional view showing an image forming device according to embodiments of the present invention.

As shown in FIG. 3, an image forming device 50 includes an image forming station and a fixing unit 26. The image forming station includes a toner supply unit 10, a modulating electrode member 1 for controlling a toner stream, and a back electrode plate 22. The fixing unit 26 is adapted for thermally fixing a toner image formed on an image recording medium 20. The modulating electrode member 1 is sandwiched between the back electrode plate 22 and the toner supply unit 10, and the modulating electrode member 1 is separated from the back electrode plate 22 by an image forming space of 1 mm. The fixing device 26 is disposed downstream of the image forming station in the sheet feeding direction F. The fixing unit 26 has a pressure roller 26*a* and a heat roller 26*b*. The pressure roller 26*a* is formed with silicon rubber on its outer periphery. A halogen heater is provided in the interior of the heat roller 26*b*.

The toner supply unit 10 includes a toner reservoir 11 storing toner particles 16 therein and also serving as a frame for the toner supply unit 10. The toner supply unit 10 also includes a toner agitator 17, a supply roller 12, a transfer roller 14, and a blade 18. The agitator 17 is disposed adjacent the supply roller 12 for agitating and conveying the toner particles 16 toward the supply roller 12 by rotating in a direction indicated by an arrow C. The supply roller 12 is disposed adjacent the transfer roller 14 for conveying the toner particles 16 supplied by the agitator 17 toward the transfer roller 14 by rotating in a direction indicated by an arrow B. The transfer roller 14 may be formed in excess of shape tolerances relating to cylindrical shape, Jolting and the like. Due to the friction at a nip portion between the supply roller 12 and the transfer roller 14, the supply roller 12 imparts a negative charge to the toner particles 16 when transferring them to the surface of the transfer roller 14. The transfer roller 14 rotates in a direction indicated by the arrow A to convey the toner particles 16 to the modulating electrode member 1.

The blade 18 is provided above the transfer roller 14 for regulating the amount of toner particles 16 to form a uniform toner layer on the peripheral surface of the transfer roller 14 and also for uniformly charging the toner particles 16. The blade 18 is a spring-like member made of stainless steel (SUS), phosphor bronze, or similar material. The blade 18 is bent to form an arc-shaped tip with a curvature of in a range from 0.2 to 0.5. The tip presses against the transfer roller 14 with an optimal pressing force.

However, it is difficult to form the tip of the blade 18 with higher precision using processes that produce a curvature in a range from 0.2 to 0.5. Therefore, great variation may occur in the curvature or surface smoothness of the tip. Because the conventional transfer roller is made of metal, the shape variation of the blade 18 has a direct effect on uniformity of the pressing force applied by the blade 18.

Next, the transfer roller 14 will be described. The transfer roller 14 has an outer elastic body made of urethane rubber surrounding a shaft made of stainless steel, free machining steel, or similar material. The elastic body of the transfer roller 14 can absorb any variation in pressing force of the blade 18 against the transfer roller 14, to render the pressing force of the blade 18 uniform against the transfer roller 14. Consequently, a uniform toner layer can be formed on the transfer roller 14.

The modulating electrode member 1 also may have a rough surface or undulating surface or may be assembled inaccurately. If so, the modulating electrode member 1 presses against the transfer roller 14 with uneven urging force along its length. However, the elastic body of the transfer roller 14 also absorbs variation in pressing force of the modulating electrode member 1 against the transfer roller 14, thereby preventing density variation in the recorded image.

Urethane rubber has a sufficient wear resistance against friction, and provides sufficient durability against repeated compression. Therefore, the urethane rubber is durable even if the rubber is repeatedly subjected to stress or frictional force by pressing against the blade 18 or the modulating electrode member 1.

The urethane rubber needs to have an electrical resistance of $10^7$ Ω order or less so that the toner particles 16 will flow in response to an electrical field. (Details will be described later.) However, it is desirable that the urethane rubber has an electrical resistance in a range from $10^2$ Ω to $10^4$ Ω. This makes the tone particles 16 have an excellent electrical response and also makes the urethane rubber have a sufficient mechanical resistance. If the urethane rubber has an electric resistance of less than $10^2$ Ω, its elasticity will be degraded so that the urethane rubber is not usable.

A method for measuring the electric resistance of the transfer roller 14 will be described next. An electrode having a length of 50 mm and a width of 15 mm is attached to the rubber surface of the transfer roller 14. Then, a voltage of 10 V is applied between the electrode and the metal shaft of the transfer roller 14. If a belt like toner transfer member is used instead of the toner transfer roller, the above-described electrodes are attached to both inner and outer surfaces of the transfer belt. Then, a voltage of 10 V is applied between these electrodes.

In order to make full use of the elasticity of urethane rubber, it is desirable that the urethane rubber have a thickness of 1 mm or more, or preferably 5 mm or more.

The elasticity of the urethane rubber is also determined by a hardness of the urethane rubber. The urethane rubber needs to have an Asker C hardness of 90 degree or less. However, it is desirable that the rubber have a hardness of between 60 degree and 80 degree. If the hardness of the rubber is less than 60 degree, the urethane rubber will be excessively deformed, and as a result, sufficient contacting pressure between the urethane rubber and the modulating electrode member 1 may not be obtained.

Roughness on the surface of the transfer roller 14 affects thickness of the toner layer on the transfer roller 14. It is desirable that the surface of the transfer roller 14 be processed to have a roughness Rz (defined in JIS B 0601-1982) of 2 $\mu$m to 6 $\mu$m in order to obtain an adequate thickness of the toner layer for the reasons to be described later. Such roughness Rz of the surface can be obtained by controlling a grinding process. A grindstone of a grinding machine is transported reciprocally along the length of the transfer roller 14, thereby shaping the surface by grinding.

Next, the modulating electrode member 1 will be described.

Figure 4:
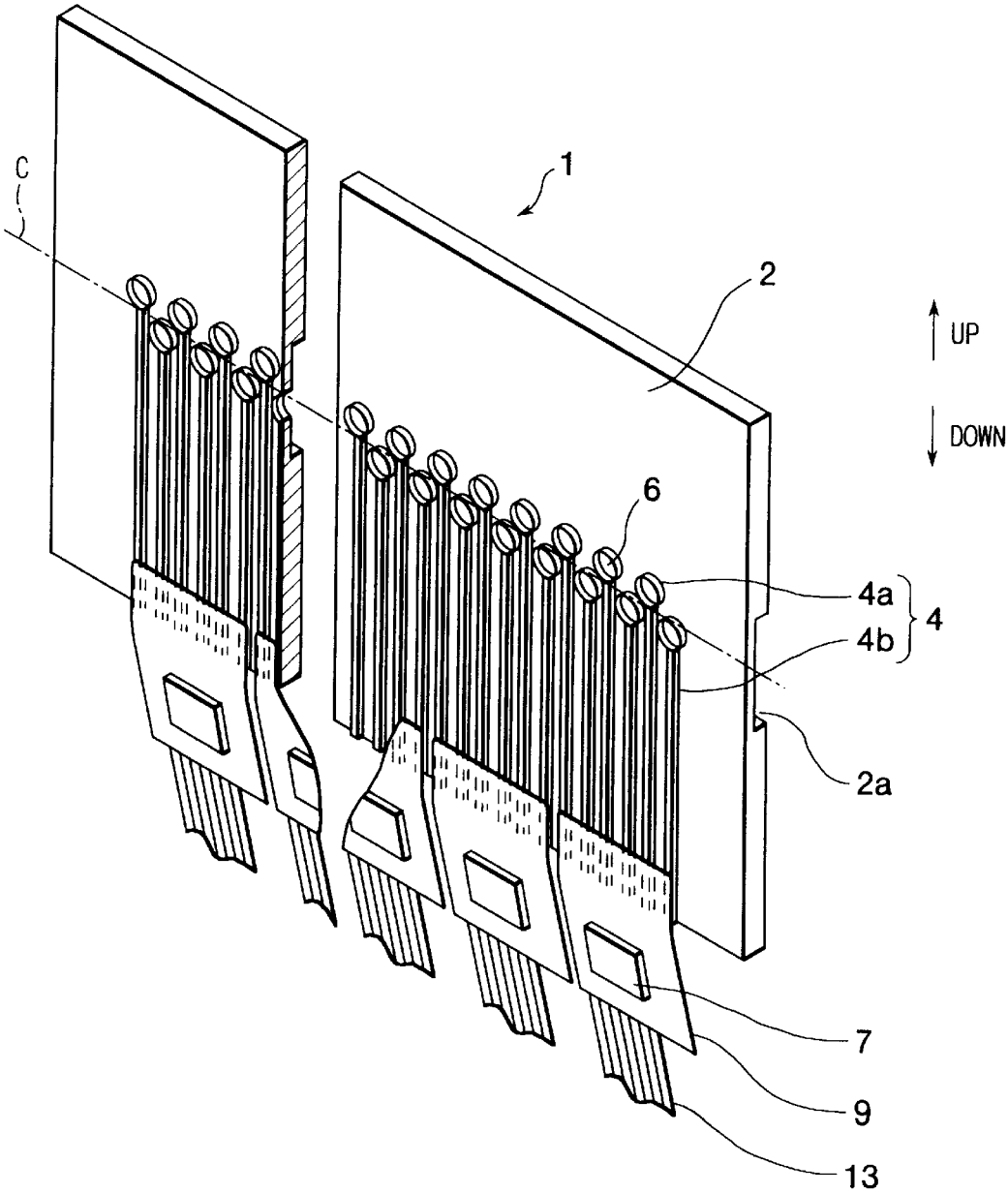
FIG. 4 is a perspective view showing a modulating electrode member incorporated in the image forming device of FIG. 3.

As shown in FIG. 4, the modulating electrode member 1 includes an insulation sheet 2, which is made of zirconia ceramics. The insulation sheet 2 is disposed in an upright posture with its upper and lower ends attached to the frame 11. A center area of the insulation sheet 2 facing the transfer roller 14 is engraved to a thickness of 30 $\mu$m following a center line C indicated by a broken line in FIG. 4 to provide an elongated groove 2*a*. A plurality of apertures 6 are formed through the center area of the insulation sheet 2 in a staggered pattern centered on the center line C. Adjacent apertures 6 are separated in the vertical direction by 160 $\mu$m pitch and in a longitudinal direction by 160 $\mu$m pitch. A control electrode 4 made from 1 $\mu$m thick gold foil is provided on the insulation sheet 2 for each aperture 6. The control electrode 4 has a ring portion 4*a* surrounding a corresponding aperture 6 and an elongated portion 4*b* extending straight downwardly from the ring portion 4*a*. The ring portion 4*a* has a radial width of 10 $\mu$m and the elongated portion 4*b* has that of 20 $\mu$m. The elongate portions 4*b* are separated by a vertical pitch of 80 $\mu$m. Tape carrier packages (TCP) 9 are mounted on the insulation sheet 2. Each TCP 9 is connected to 250 of the control electrodes 4 in this embodiment. An integrated circuit (IC) 7 is mounted on each TCP 9 and has 250 output terminals 13 aligned in a pitch of 80 $\mu$m. Each output terminal 13 is mechanically and electrically connected to a respective control electrode 4.

Next, a method for connecting the control electrodes 4 to the output terminals 13 will be described. Regardless of type of measuring methods, special equipment is required. First, an anisotropic conducting film is prepared from a thermosetting resin containing plastic particles coated with metal. The film is placed over the control electrodes 4, and then, temporarily bonded to the control electrodes 4 by thermocompression. Specifically, the film is heated to a temperature between 80° C. and 90° C. for 5 seconds while compressed at 1 MPa/cm$^2$. The TCP 9 are precisely placed over the insulation sheet 2 so that each terminal 13 is positioned at a respective control electrode 4. The TCP 9 are temporarily bonded to the insulation sheet 2 by thermocompression in the same manner described above. Then, the temporarily bonded portions are heated to a temperature between 170° C. and 180° C. for approximately 20 seconds while compressed in a range from 2 MPa/cm$^2$ to 3 MPa/cm$^2$ so that the films are fully fluidized to form permanent bonds from the temporary bonds. Because the anisotropic conducting film is conductive only in its thickness direction, the control electrodes 4 are electrically connected to the respective output terminals in one-to-one correspondence.

Figure 5:
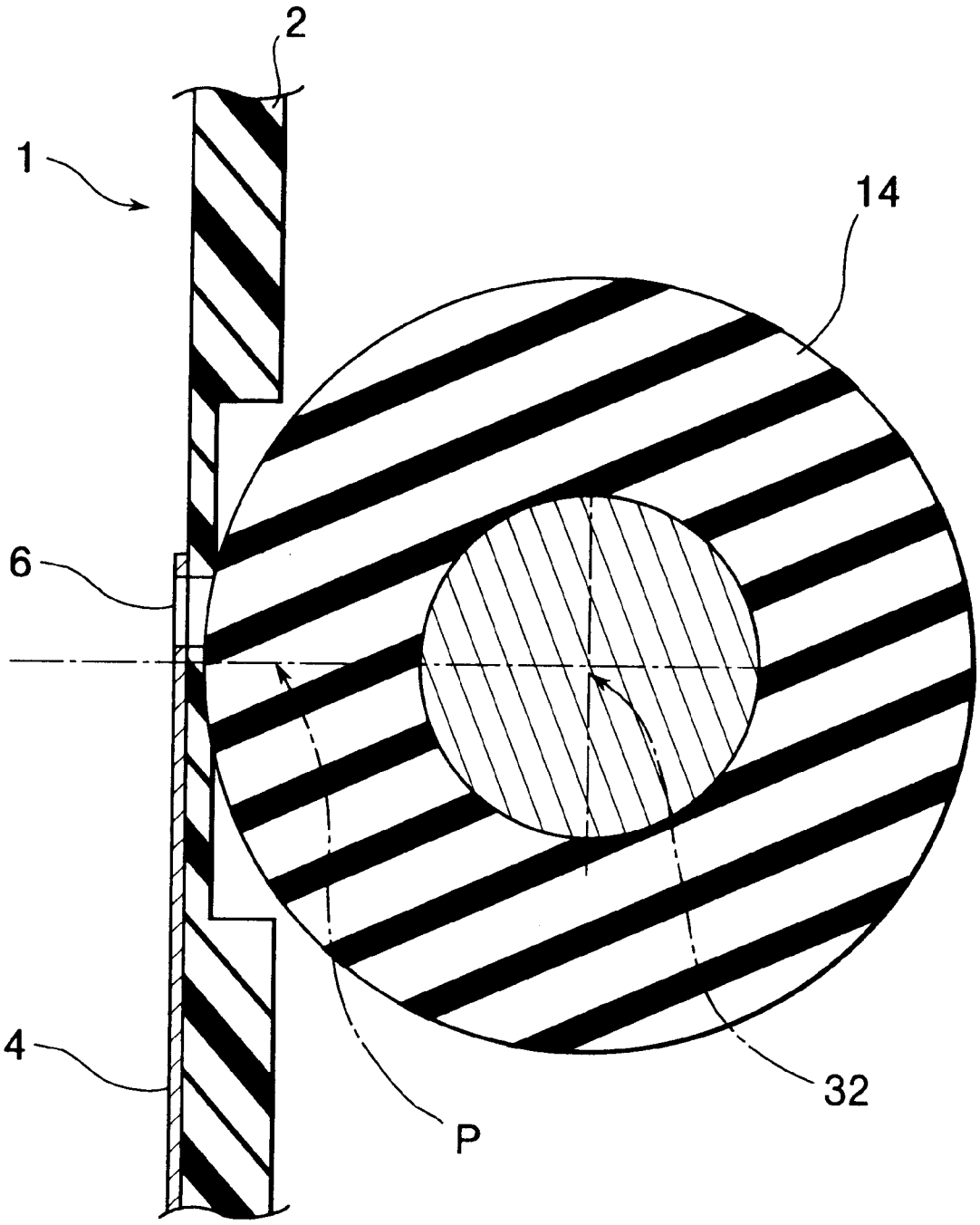
FIG. 5 is a cross-sectional view showing a relationship between a modulating electrode member and a transfer roller incorporated in the image forming device shown in FIG. 3.
Figure 6:
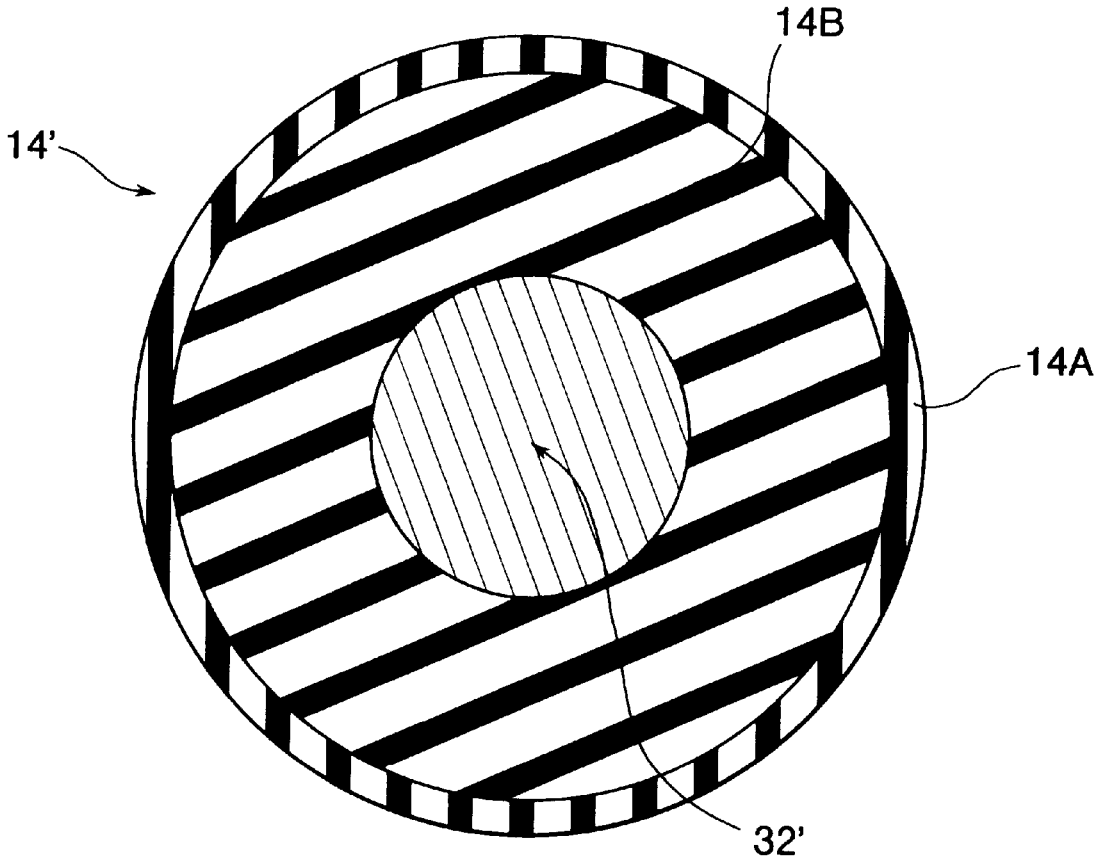
FIG. 6 is a cross sectional view showing a toner transfer roller according to a second embodiment of the present invention.

Next, a positional relationship between the insulation sheet 2 of the modulating electrode member 1 and the transfer roller 14 will be described. As shown in FIG. 5, the transfer roller 14 is positioned so that a central plane P equally dividing the elongated groove 2*a* and passing through the center line C intersects with an axis 32 of the transfer roller 14. The transfer roller 14 is urged toward the modulating electrode member 1 so that an upper half and a lower half of the modulating electrode member 1 deform symmetrically. As such, the contacting area between the transfer roller 14 and the modulating electrode member 1 is increased and the transfer roller 14 uniformly contacts the aperture 6.

As shown in FIG. 3, a data control circuit 8 is connected between the TCP 9 and the transfer roller 14. The data control circuit 8 controls the IC 7 on each TCP 9 to supply −10 volts voltage or +35 volts voltage to corresponding control electrodes 4 based on an image signal fed from an image signal receiving means (not shown in the drawings) connected to any one of an external computer, an image reading device, or an image communication device.

A back voltage supplying circuit 24 is connected between the back electrode plate 22 and the transfer roller 14. The back voltage supplying circuit 24 supplies a +1 kilovolts voltage to the back electrode plate 22.

Next, operation of the image forming device shown in FIG. 3 will be described.

Rotation of the supply roller 12 conveys the toner particles 16 stored in the toner reservoir 11 toward the transfer roller 14. The toner particles 16 are subjected to rubbing at the nipping portion between the supply roller 12 and the transfer roller 14, and provided with a negative charge. The toner is held on the peripheral surface of the transfer roller 14. The blade 18 regulates the amount of the toner particles 16 on the transfer roller 14 to form a uniform toner layer of uniformly charged toner particles 16.

Because the peripheral surface of the transfer roller 14 is made of elastic material, the transfer roller 14 adequately deforms at the contacting portion between the transfer roller 14 and the blade 18. In this way, uneven pressing force developed between the blade 18 and the transfer roller 14 is offset, thereby preventing variation in toner density in a recorded image.

Thus formed toner layer is, then, conveyed toward the aperture 6 in accordance with rotation of the transfer roller 14 while rubbed against the insulation sheet 2 of the modulating electrode member 1.

Next, image forming operation will be described.

When a picture element, that is, a dot is to be formed on the recording medium 20, a control circuit within each of the TCP 9 selectively applies +35 volts to the control electrodes 4 in accordance with the image signal fed from the image signal reception means (not shown in the drawings). Voltage difference that develops between the control electrode 4 to which the +35 volts voltage is applied and the transfer roller 14 generates at the corresponding aperture 6 an electric flux lines extending from the control electrode 4 to the transfer roller 14. Electrostatic force is imparted on the negatively charged toner particles 16 to move them in the direction of a higher potential of the electrode 4, so that the toner particles 16 rise from the transfer roller 14 and pass through the apertures 6 of the control electrodes 4. Further, the back voltage supplying circuit 24 applies a +1 kilovolts voltage to the back electrode plate 22, so that an electric field is formed between the modulating electrode member 1 and the image recording medium 20 held on the back electrode plate 22. Because electric field formed between the aperture electrode assembly 1 and the image recording medium 20 is stronger than the electric field at the aperture 6, the toner particles 16 move from the aperture 6 toward and cling to the image recording medium 20 to form a picture element thereon.

On the other hand, when a dot is not to be formed on the image recording medium, the data control circuit 8 selectively applies a −10 V volts voltage to the corresponding control electrode 4 so that no electric field forms between the transfer roller 14 and the control electrode 4. Because no electrostatic force is imparted on the toner particles 16 held on the transfer roller 14, the toner particles 16 do not pass through the apertures 6 and accordingly no picture elements are formed on the image recording medium 20 in portions confronting the control electrode 4.

When one row of picture elements is formed on the surface of the image recording medium 20, the image recording medium 20 is transported in the direction perpendicular to the line of apertures 6 by a transportation mechanism (not shown in the drawings) by an amount corresponding to one row of picture element. By repeatedly forming picture elements and transporting the recording medium 20 in this manner, a recorded image can be formed across the entire surface of the recording medium 20.

The image recording medium 20 carrying the recorded image is transported to the fixing device 26 where the recorded image is thermally fixed to the recording medium 20. Alternatively, the fixing device 26 can fix the recorded image by pressing to toner image onto the recording medium rather than thermally fixing the toner image.

In the image forming device 50, short circuits between the control electrodes 4 and the transfer roller 14 are prevented because the insulation sheet 2 of the modulating electrode member 1 faces the transfer roller 14, so that the control electrodes 4 and the transfer roller 14 are not brought into direct contact with each other. Therefore, even when no toner particle 16 clings to the surface of transfer roller 14, the control electrode 4 will be electrically insulated from the transfer roller 14. For some reasons, no toner particles 16 may be accumulated on the surface of the transfer roller 14. Accordingly, the IC 7 of the TCP 9 will not be damaged resulting from the short-circuiting of the control electrodes 4 with the transfer roller 14.

As described above, a +35 volts voltage is applied to the control electrodes 4 in order to pull the toner particles 16 toward the respective apertures 6, and a −10 volts voltage to retain the toner particles 16 on the transfer roller 14. The electric difference of 45 volts between the +35 volts and the −10 volts is called a control voltage range. When the control voltage range is small, inexpensive ICs can be used. Also, short circuits are less likely to occur between two control electrodes 4 or between a control electrode 4 and the transfer roller 14. It is desirable that a control voltage range be 50 volts or less, so that an inexpensive IC of 60 volts output can be used. This type of IC is easy to produce in view of its voltage margin.

As described above, the transfer roller is preferably formed with a surface roughness Rz in a range from 2 μm to 6 μm. Reasons for this will be described next while referring to FIG. 7.

Figure 7:
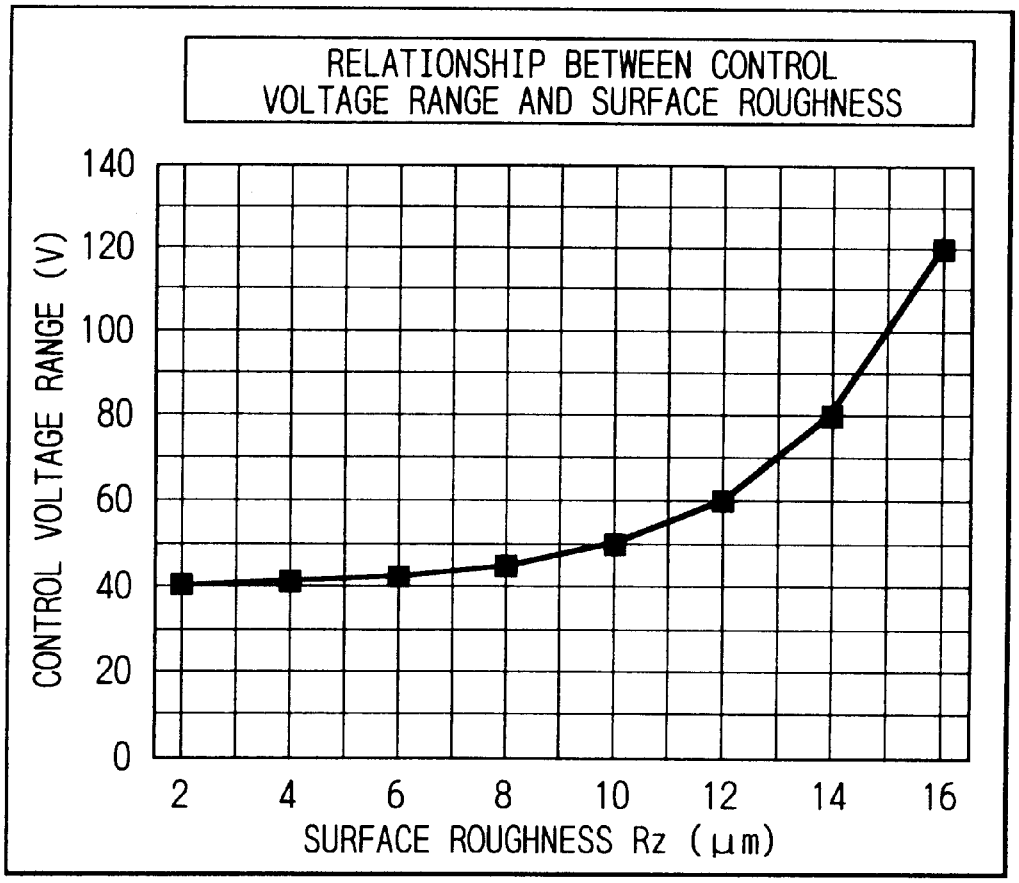
FIG. 7 is a graph showing a relationship between a surface roughness of a transfer roller and a control voltage range.

As shown in FIG. 7, the control voltage range is 50 volts or less when the surface roughness Rz is 10 μm or less. Therefore, it is preferable that the surface roughness Rz is 10 μm or less. However, it is further preferable that the surface roughness Rz be 6 μm or less in order to effectively prevent a fog in a recorded image.

On the other hand, if the surface roughness Rz is less than 1 μm, the transfer roller 14 cannot hold the toner particles 16 well on its surface. Also, if the surface roughness Rz is less than 2 μm, the transfer roller 14 can hold only an insufficient amount of toner particles 16, and then the transfer roller 14 needs to rotate at a relatively high speed. This makes the transfer roller 14 less durable.

Therefore, when the surface roughness Rz of the transfer roller 14 is 2 μm to 6 μm, the toner layer with an optimum thickness can be formed on the surface of the transfer roller 14. Also, the toner particles 16 on the transfer roller 14 can be selectively pulled toward the image recording medium 20 with a relatively small control voltage range of 45 volts.

Next, an image forming device according to a second embodiment will be described. Because the image forming device of the second embodiment has the same components and the structure, except a transfer roller, as that of the first embodiment, duplication in explanation will be avoided.

In the first embodiment, during the grinding process for shaping the surface of the transfer roller 14, the reciprocating movement of the machine may leave traces and undulation on the surface, and portions of rubber may be torn off. Such unevenness in the surface of the transfer roller 14, cause an uneven pressing force between the modulating electrode member 1 and the transfer roller 14 resulting in forming an uneven toner layer, and then, variation in toner density in a recorded image.

Still, such unevenness of the surface of the transfer roller 14 causes not much problem in monochromatic printing. It is because density variation of a toner printing may be invisible to the eye if each dot includes a certain amount of toner and so has a certain toner density. As long as a fog on a printing medium is avoided, a recorded image seems clear. However, in multi-color printing, the various colors of an image are achieved by precisely controlling amounts of different colored toners in each dot. Failure to control quantities of the different toners will cause a density variation which is clearly noticeable.

In order to further improve the first embodiment, a transfer roller 14' of the second embodiment has a polyurethane resin layer 14A coated over an elastic body 14B. By coating the polyurethane resin layer 14A over the body 14B using dipping technique, the outer peripheral surface of the transfer roller 14' will be smooth, thereby preventing such problems. The layer 14A should be formed to a thickness of at least 5 μm to fill in unevenness on the surface of the elastic body 14B. It is desirable that the layer 14A be formed to a thickness of 20 μm to 40 μm, with 30 μm being the optimum thickness. If the layer 14A is formed to a thickness of greater than 40 μm, potential variation in the thickness of the layer 14A will cause other drawbacks.

The polyurethane resin layer 14A is durable and holds the toner particles 16 stably thereon and so is a preferable material for forming the transfer roller 14'. It is preferable that the dipping process be controlled to form the polyurethane layer 14A of the transfer roller 14' with a roughness Rz 10 μm or less, or preferably ranging from 2 μm to 6 μm.

A method for measuring the electric resistance of the transfer roller 14' will be described next. An electrode having a length of 50 mm and a width of 15 mm is attached to the polyethylene resin surface of the transfer roller 14'. Then, a voltage of 10 V is applied between the electrode and the metal shaft of the transfer roller 14'.

While the invention has been described in detail with reference to specific embodiments thereof, it would be apparent to those skilled in the art that various changes and modifications may be made therein without departing from the spirit of the invention, the scope of which is defined by the attached claims.

For example, a toner particle transfer member can be belt shaped rather than roller shaped. Also, the transfer roller 14, 14' can be formed with a method to cover the shaft with a rubber tube.

The elastic body 14B of the transfer roller 14' can be made of silicon rubber, nitrile-butadiene rubber, chloroprene rubber, natural rubber, styrene-butadiene rubber, or butyl rubber. There is no direct contact between the elastic body 14B and the tone particles 16. Therefore, a material for the elastic body 14B can be selected from a variety kinds of materials without limited by characteristics of toner material and versa visa.

Also, the insulation sheet 2 of the modulating electrode member 1 can be made of a polyimide instead of a ceramic.

An elongated slit instead of a plurality of apertures can be formed in the insulation sheet 2 of the modulating electrode member 1 as described in Japanese Laid-Open Application (Kokai) No. HEI-6-255163.

The layer 14A coated over the elastic body 14B of the transfer roller 14' can be made of urethane rubber, or any other resin or rubber as long as the coating layer 14A provides a proper elasticity and surface roughness.

A lattice-shaped matrix electrode assembly as disclosed in U.S. Pat. No. 5,036,341 can be used as a modulating electrode member.

What is claimed is:

1. An image forming device, comprising:

an electrode array including a substrate being formed with a plurality of apertures arranged in a row extending in a predetermined direction, and a plurality of control electrodes provided on the substrate for respective ones of the apertures, the plurality of control electrodes generating an electric field in the respective apertures when applied with a driving voltage;

a back electrode confronting the substrate; and a particle transfer member supplying electrically charged particles to the electrode array, the particle transfer member having a toner carrying surface which is in contact with the substrate at a position near the plurality of apertures, wherein when the plurality of control electrodes are applied with the driving voltage, the electrically charged particles are pulled through the apertures by the electrical field, and wherein the toner carrying surface is made of an elastic material so that the toner carrying surface resiliently contacts the substrate with a uniform pressure in the predetermined direction.

2. The image forming device according to claim 1, wherein the toner particle transfer member comprises a shaft and an elastic body provided over the shaft, the elastic body having an outer peripheral surface serving as the toner carrying surface.

3. The image forming device according to claim 2, wherein the outer peripheral surface of the elastic body has a roughness Rz of 10 μm or less.

4. The image forming device according to claim 3, wherein the outer peripheral surface of the elastic body has a roughness ranging from 2 μm to 6 μm.

5. The image forming device according to claim 2, wherein the elastic body is made of urethane rubber.

6. The image forming device according to claim 2, wherein the elastic body has a thickness of 1 mm or more.

7. The image forming device according to claim 6, wherein the elastic body has a thickness of 5 mm or more.

8. The image forming device according to claim 2, wherein an electric resistance of the elastic body is $10^7$ Ω order or less.

9. The image forming device according to claim 8, wherein the electric resistance of the elastic body is ranging from $10^2$ Ω to $10^4$ Ω order.

10. The image forming device according to claim 2, wherein the elastic body has an Asker C hardness of 90 degree or less.

11. The image forming device according to claim 10, wherein the elastic body has an Asker C hardness ranging from 60 degree to 80 degree.

12. The image forming device according to claim 2, further comprising;

a control electrode driving unit electrically connected to the plurality of the control electrodes for selectively applying a voltage to the plurality of the control electrodes based on a control signal; and a back electrode driving unit electrically connected to the back electrode for applying a voltage to the back electrode.

13. The image forming device according to claim 1, wherein the particle transfer member comprises a shaft, an elastic body provided over the shaft, and a coating layer formed over the elastic body, the coating layer having an outer peripheral surface serving as the toner carrying surface.

14. The image forming device according to claim 13, wherein the coating layer is made of an elastic material.

15. The image forming device according to claim 14, wherein the coating layer is made from polyurethane resin.

16. The image forming device according to claim 14, wherein the coating layer is made from urethane rubber.

17. The image forming device according to claim 14, wherein the elastic body is made from a material selected from the group consisting of silicon rubber, nitrile-butadiene rubber, chloroprene rubber, natural rubber, styrene-butadiene rubber, and butyl rubber.

18. The image forming device according to claim 13, wherein the coating layer has a thickness ranging from 5 μm to 40 μm.

19. The image forming device according to claim 18, wherein the coating layer has a thickness ranging from 20 μm to 40 μm.

20. The image forming device according to claim 13, wherein an electric resistance of the particle transfer member is $10^7$ Ω order or less.

21. The image forming device according to claim 20, wherein the electric resistance of the elastic body is ranging from $10^2$ Ω to $10^4$ Ω order.

22. An image forming device according to claim 13, wherein the outer peripheral surface of the coating layer has a roughness Rz ranging from 2 $\mu$m to 6 $\mu$m.

23. An image forming device according to claim 13, further comprising;

a control electrode driving unit electrically connected to the plurality of the control electrodes for selectively applying a voltage to the plurality of the control electrodes based on a control signal; and a back electrode driving unit electrically connected to the back electrode for applying a voltage to the back electrode.

24. A particle transfer member for use in an image forming device, the image forming device including;

an electrode array including a substrate being formed with a plurality of apertures, and a plurality of control electrodes provided on the substrate for respective ones of the apertures;

a control electrode driving unit electrically connected to the plurality of the control electrodes for selectively applying a voltage to the plurality of the control electrodes based on a control signal;

a back electrode confronting the substrate; and a back electrode driving unit electrically connected to the back electrode for supplying a voltage thereto;

a particle transfer member supplying electrically charged particles to the plurality of apertures, the particle transfer member confronting the substrate; and wherein the particle transfer member comprises a shaft, an elastic body provided over the shaft, and a coating layer formed over the elastic body, the coating layer having an outer peripheral surface serving as a toner carrying surface;

the coating layer is made of an elastic material;

the coating layer has a thickness ranging from 5 $\mu$m to 40 $\mu$m;

the outer peripheral surface has a roughness Rz of 10 $\mu$m or less; and an electric resistance of the particle transfer member is $10^7$ Ω order or less.

25. An image forming device according to claim 1, further comprising a blade that regulates an amount of particles to form a uniform layer on the toner carrying surface, and uniformly charges the particles, the blade being bent to form an arc-shaped tip with a curvature of in a range from 0.2 to 0.5, wherein the toner carrying surface resiliently contacts the blade with a uniform pressure in the predetermined direction.

26. An image forming device, comprising:

an electrode array including a substrate being formed with a plurality of apertures arranged in a row extending in a predetermined direction, and a plurality of control electrodes provided on the substrate for respective ones of the apertures, the plurality of control electrodes generating an electric field in the respective apertures when applied with a driving voltage;

a back electrode confronting the substrate;

a particle transfer member supplying electrically charged particles to the electrode array, the particle transfer member having a toner carrying surface, wherein when the plurality of control electrodes are applied with the driving voltage, the electrically charged particles are pulled through the apertures by the electrical field; and a blade that regulates an amount of particles to form a uniform layer on the toner carrying surface of the particle transfer member, and uniformly charges the particles, the blade being in contact with the toner carrying surface, and wherein the toner carrying surface is made of an elastic material so that the toner carrying surface resiliently contacts the blade with a uniform pressure in the predetermined direction.

27. The image forming device according to claim 26, wherein the toner particle transfer member comprises a shaft and an elastic body provided over the shaft, the elastic body having an outer peripheral surface serving as the toner carrying surface.

28. The image forming device according to claim 27, wherein the elastic body has a thickness of 1 mm or more.

29. The image forming device according to claim 27, wherein the elastic body has an Asker C hardness of 90 degree or less.

30. The image forming device according to claim 26, wherein the particle transfer member comprises a shaft, an elastic body provided over the shaft, and a coating layer formed over the elastic body, the coating layer having an outer peripheral surface serving as the toner carrying surface.

31. The image forming device according to claim 30, wherein the coating layer is made of an elastic material.

32. The image forming device according to claim 30, wherein the coating layer has a thickness ranging from 5 $\mu$m to 40 $\mu$m.

* * * * *